US006113772A

United States Patent [19]

Rompuy

[11] Patent Number: 6,113,772

[45] Date of Patent: Sep. 5, 2000

[54] METHOD FOR MAKING LITHOGRAPHIC PRINTING PLATES BASED ON ELECTROPLATING

[75] Inventor: Ludo Van Rompuy, Mortsel, Belgium

[73] Assignee: Agfa-Gevaert, N.V., Mortsel, Belgium

[21] Appl. No.: 09/252,676

[22] Filed: Feb. 22, 1999

Related U.S. Application Data

[60] Provisional application No. 60/081,761, Apr. 15, 1998.

[30] Foreign Application Priority Data

Mar. 13, 1998 [EP] European Pat. Off. ..... 98200830

[51] Int. Cl.[7] ..... C23C 28/02; C25D 5/48; C25D 5/54

[52] U.S. Cl. ..... 205/184; 205/220; 205/163

[58] Field of Search ..... 205/184, 220, 205/163

[56] References Cited

U.S. PATENT DOCUMENTS

| | | | |
|---|---|---|---|
| 2,676,886 | 4/1954 | Barbarite | 95/5.4 |
| 3,335,072 | 8/1967 | Cuzner et al. | 204/17 |
| 4,519,876 | 5/1985 | Lee et al. | 204/15 |

*Primary Examiner*—Kathryn Gorgos
*Assistant Examiner*—Eana Wong
*Attorney, Agent, or Firm*—Breiner & Breiner

[57] ABSTRACT

According to the present invention there is provided a method for making lithographic printing plates or a printing cylinder including the steps of applying image-wise a solution of ions of an oleophilic metal with an ink jet on a hydrophilic metallic base and reducing said ions by electroplating in order to obtain an oleophilic metal image.

9 Claims, No Drawings

METHOD FOR MAKING LITHOGRAPHIC PRINTING PLATES BASED ON ELECTROPLATING

This application claims the benefit of U.S. Provisional Application No. 60/081,761, filed Apr. 15, 1998.

FIELD OF THE INVENTION

This invention relates to lithographic printing, and is particularly related to a method for producing lithographic plates by image-wise electroplating an oleophilic metal.

BACKGROUND OF THE INVENTION.

In lithographic printing, a lithographic plate having a hydrophilic surface coated with a hydrophobic material forming an image is mounted on a lithographic press. Typically the plate is rotated beneath a water source to spread water across the plate, and then hydrophobic ink is applied to the plate. The hydrophobic ink does not stick on the uncoated surface of the plate because of the water extending over the uncoated surface. The hydrophobic image repels the water but attracts the ink, and thus ink is applied to the image. The inked image is then used to make lithographic copies.

Many techniques for producing lithographic plates have been developed. In one common method, plates having photosensitive coatings are exposed and developed to leave a hydrophobic image on the plate corresponding to the lithographic image to be printed. The unexposed portion of the plate remains hydrophilic. According to another technique, a transparent sheet having a special coating of graphite and a binder is placed over a plate and subjected to laser beam imaging. The laser beam causes the graphite and binder to transfer to the plate surface to create a hydrophobic image on the plate. Yet another technique includes making plates from a prepared original using master imager machines that resemble photocopiers. According to still another method, a liquid ink is sprayed onto a plate through a stencil and then the plate is heated to harden the ink.

Unfortunately, the prior methods have numerous disadvantages. Some methods require special chemicals, materials or coatings on the plate and a developing or heating step to affix the image to the plate. Other methods require expensive, single purpose equipment, expensive and often potentially harmful chemicals, or considerably operator time to make the lithographic plate. Still other methods require the operator to make an original or a stencil image first and then use the original or stencil to make the plate. However, the original or stencil must be made through other means, requiring time and additional materials. In many if not most cases, the plates are used once and discarded, thereby destroying the image. As a result, short runs are often economically impractical and many businesses cannot afford the expense associated with lithographic printing.

In U.S. Pat. No. 5,206,102 there is claimed a method of reproducing an image on a printing plate, comprising the steps of (a) providing a surface layer of hydrophilic semiconductor material on the plate; (b) applying a film of a metal plating solution on said surface layer of semiconductor material; (c) illuminating selected areas of said surface layer of semiconductor material through said film of plating solution and (d) photoelectrochemically depositing a layer of oleophilic metal plating material on said illuminated areas of said surface layer of semiconductor material to form the image: However said method needs a laser imager which is an expensive tool.

OBJECTS OF THE INVENTION

It is an object of the invention to provide a method for making lithographic printing plates with the use of ink jet printheads.

It is further an object of the present invention to provide a method for making lithographic printing plates for a long run.

Further objects of the present invention will become clear from the description hereinafter.

SUMMARY OF THE INVENTION

According to the present invention there is provided a method for making lithographic printing plates or a printing cylinder including the steps of applying image-wise a solution of ions of an oleophilic metal with an ink jet on a hydrophilic metallic layer and reducing said ions by electroplating in order to obtain an oleophilic metal image.

DETAILED DESCRIPTION OF THE INVENTION

According to the present invention, the hydrophilic metallic layer can consist of any metal that is hydrophilic. Preferred is an aluminum layer, more preferably an electrochemically grained and anodised aluminum support. Most preferably said aluminum support is grained in nitric acid, yielding imaging elements with a higher sensitivity. According to the present invention, an anodised aluminum support may be treated to improve the hydrophilic properties of its surface. For example, the aluminum support may be silicated by treating its surface with sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or can be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, and acetals of polyvinyl alcohols formed by reaction with a sulphonated aliphatic aldehyde. It is further evident that one or more of these post treatments may be carried out alone or in combination.

In another embodiment of the present invention said hydrophilic metallic layer can be part of a multimetal plate whereof at least one outer layer is a hydrophilic metallic layer. A multimetal plate is a plate comprising layers of more than one metal. An example of such a plate is an aluminum layer coated with a hydrophilic chromium layer. These plates are more expensive than an aluminum base but are preferred for very high editions because said plates are very wear-resistant and can print a number of copies that is not possible to be printed with an aluminum base.

The solution of ions of an oleophilic metal is preferably a solution of copper ions. Said copper ion containing solution is preferably a solution of copper pyrophosphate or copper nitrate. Said electrolytes are preferred plating solutions because they are energetically favourable, are environmentally benign with low corrosivity and yield high quality Cu deposits without organic derivatives. Other copper plating electrolytes may be used, including acid copper sulphate, copper cyanide and any of various copper plating baths.

As solvent preferably water or a mixture of water and organic solvents can be used, but it is possible to use pure organic solvents. Optionally ingredients such as binders, surfactants, dispersing agents, biocides etc. can also be present in the solution as is obvious for one skilled in the art.

In order to increase the hydrophobicity of the deposited copper, organic hydrophobic compounds may be added in a minor amount, preferably not higher than 10% by weight in the solution of ions of an oleophilic metal. Organic hydrophobic compounds are compounds which contain a mercapto or a thiolate group and one or more hydrophobic substituents e.g. an alkyl containing at least three carbon atoms. Examples of these compounds for use in accordance with the present invention are e.g. phenyl mercaptotetrazoles or those described in U.S. Pat. No. 3,776,728 and U.S. Pat. No. 4,563,410.

Printers suitable for use in the present invention are piezo-or thermal drop-on-demand printers or so called continuous jet printers which are well known to those skilled in the art. Such printers are described in e.g. WO-90/005,893 and EP-A-623,472. The image forming requires the following steps. The solution containing ions of an oleophilic metal is held in a reservoir and fed in the ink jet printhead. On demand, microdots of said solution are sprayed onto the hydrophilic metallic base in a computer generated predetermined pattern as the plate passes through the printer. According to one embodiment of the invention, the microdots have a diameter of less than 50 $\mu$m. Upon contact with the base the solution leaves an upraised pattern on the base.

In a following step the ions of the oleophilic metal are reduced by electroplating. In one embodiment the hydrophilic metal base is connected to the negative pole of an electric potential source and the electrical circuit is closed by contacting the drop of the solution of an oleophilic metal with an electrode connected to the positive pole of said electric potential source. Said electrode has preferably the form of a needle with a diameter of the point of less than 50 $\mu$m, more preferably less than 25 $\mu$m. The electric potential source has a tension of at least the reduction potential of the ion, preferably of at least 5 volt, more preferably of at least 10 volt. The current is preferably at least 0.1 A, more preferably at least 0.3 A. After said electroplating, the plate is ready to be used as a lithographic printing plate The hydrophilic metallic layer can be a plate or a printing cylinder. The imaging of the printing cylinder can be carried out either off-press or on-press. The printing plate of the present invention can also be used in the printing process as a seamless sleeve printing plate. This cylindrical printing plate which has as diameter the diameter of the print cylinder is slided on the print cylinder instead of applying in a classical way a classically formed printing plate. More details on sleeves are given in "Grafisch Nieuws" ed. Keesing, 15, 1995, page 4 to 6.

It is easily thought of to increase the resolution of the plate by creating small charged spots in the hydrophilic metallic base, separated from each other by isolation barriers, whereby said isolation barriers are small compared to the small charged spots. Said small charged spots have an opposite charge of the solution of ions of the oleophilic metal and thus concentrate the deposition of the solution of ions of the oleophilic metal.

The following examples illustrate the present invention without limiting it thereto. All parts and percentages are by weight unless otherwise specified.

EXAMPLE 1

Preparation of the hydrophillic metallic base

A 0.30 mm thick aluminum foil was degreased by immersing the foil in an aqueous solution containing 5 g/l of sodium hydroxide at 50° C. and rinsed with demineralized water. The foil was then electrochemically grained using an alternating current in an aqueous solution containing 4 g/l of hydrochloric acid, 4 g/l of hydroboric acid and 5 g/l of aluminum ions at a temperature of 35° C. and a current density of 1200 A/m$^2$ to form a surface topography with an average center-line roughness Ra of 0.5 $\mu$m.

After rinsing with demineralized water the aluminum foil was then etched with an aqueous solution containing 300 g/l of sulfuric acid at 60° C. for 180 seconds and rinsed with demineralized water at 25° C. for 30 seconds.

The foil was subsequently subjected to anodic oxidation in an aqueous solution containing 200 g/l of sulfuric acid at a temperature of 45° C., a voltage of about 10 V and a current density of 150 A/m$^2$ for about 300 seconds to form an anodic oxidation film of 3.00 g/m$^2$ of $Al_2O_3$, then washed with demineralized water and posttreated with a solution containing polyvinylphosphonic acid rinsed with demineralized water at 20° C. during 120 seconds and dried.

Preparation of the lithographic plate

A lithographic plate according to the invention was produced by applying image-wise by means of an ink jet writing head droplets of an aqueous saturated $Cu(NO_3)_2$ on the hydrophilic metallic base and reducing said copper ions to copper by connecting the aluminum base to the negative electrode of an electric potential source (20 V, 1 A) and closing the electric circuit by contacting needlelike positive electrodes, connected to the positive pole of said electric potential source, with the droplets.

Printing

The lithographic plate was applied on an AB DICK printing press (trade mark of AB Dick co.) and printed with a conventional ink Van Son Rubberbase and a conventional fountain Tame 2%. Even the first copy had a good ink acceptance. Even after 100 copies the lithographic plate showed no wear.

What is claimed is:

1. A method for making lithographic printing plates including the steps of applying image-wise a solution of ions of an oleophilic metal with an ink jet on a hydrophilic metallic layer and reducing said ions by electroplating in order to obtain an oleophilic metal image and following said electroplating, said hydrophilic metallic layer is used as a lithographic printing plate.

2. A method for making lithographic printing plates according to claim 1 wherein said hydrophilic metallic layer is a grained and anodized aluminum layer.

3. A method for making lithographic printing plates according to claim 2 wherein said grained and anodized aluminum layer has been treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, or acetals of polyvinyl alcohols formed by reaction with a sulphonated aliphatic aldehyde.

4. A method for making lithographic printing plates according to claim 1 wherein said solution of ions of an oleophilic metal is a solution of copper ions.

5. A method for making lithographic printing plates according to claim 4 wherein said copper ion containing solution is a solution of copper pyrophosphate or copper nitrate.

6. A method for making lithographic printing plates according to claim 1 wherein the ions of the oleophilic metal are reduced by electroplating by connecting the hydrophilic metallic layer to the negative pole of an electric potential source and closing the electrical circuit by contacting the drop of the solution of an oleophilic metal with an electrode connected to the positive pole of said electric potential source, thereby causing an electrical current.

7. A method for making lithographic printing plates according to claim 6 wherein said electrode has the form of a needle with a diameter of the point of less than 50 $\mu$m.

8. A method for making lithographic printing plates according to claim 6 wherein the electric potential source has a tension of at least the reduction potential of said ion.

9. A method for making lithographic printing plates according to claim 6 wherein the current is at least 0.1 A.

* * * * *